United States Patent [19]

Espenscheid et al.

[11] 4,036,770

[45] July 19, 1977

[54] STABILIZATION OF HYDROCRACKED OILS WITH AMINO NITROPHENOLS

[75] Inventors: Wilton F. Espenscheid, Princeton; Robert D. Offenhauer, Pennington; Tsoung Y. Yan, Trenton, all of N.J.

[73] Assignee: Mobil Oil Corporation, New York, N.Y.

[21] Appl. No.: 623,280

[22] Filed: Oct. 17, 1975

[51] Int. Cl.[2] ..... C10M 1/32

[52] U.S. Cl. ..... 252/51.5 R; 252/403

[58] Field of Search ..... 252/51.5 R, 403; 208/18, 19

[56] References Cited

U.S. PATENT DOCUMENTS

| | | | |
|---|---|---|---|
| 2,151,300 | 3/1939 | Moran et al. | 252/51.5 R X |
| 2,248,925 | 7/1941 | Lincoln et al. | 252/51.5 R X |
| 2,326,938 | 8/1943 | Fuller et al. | 252/51.5 R X |
| 2,525,508 | 10/1950 | Zimmerman | 260/575 |
| 2,592,435 | 4/1952 | Lacomble | 252/51.5 R |
| 3,062,887 | 11/1962 | Levering et al. | 252/51.5 R X |
| 3,090,786 | 5/1963 | Levering et al. | 252/51.5 R X |
| 3,380,918 | 4/1968 | Anderson | 252/51.5 R |
| 3,629,113 | 11/1971 | Gerlicher | 252/51.5 R X |
| B 650,952 | 3/1972 | Gerlicher | 252/51.5 R X |

*Primary Examiner*—Delbert E. Gantz
*Assistant Examiner*—Andrew H. Metz
*Attorney, Agent, or Firm*—Charles A. Huggett; Raymond W. Barclay; Claude E. Setliff

[57] ABSTRACT

Hydrocracked oils are stabilized against deterioration due to exposure to light and/or air by adding to them a small amount of aromatic amine having a nitro group, the amino and nitro groups being ortho or para to each other.

7 Claims, No Drawings

STABILIZATION OF HYDROCRACKED OILS WITH AMINO NITROPHENOLS

BACKGROUND OF THE INVENTION

1. Field of the Invention

The invention relates to a method of stabilizing a hydrocracked oil. More particularly, it relates to stabilizing such oils against light and/or air deterioration by adding thereto a nitro-containing aromatic amine wherein the amino and nitro groups are ortho or para to each other.

2. Discussion of the Prior Art

It is known that oils in general will degrade slowly in the presence of light and/or air. Some, such as certain fule oils degrade in the light as well as in darkness. Oils such as the economically valuable hydrocracked lubricating oils used in this invention, degrade in light, either in the presence or absence of air. They do not, however, degrade in the dark.

Since the hydrocracked oils are valuable, there has been considerable effort to find ways to prevent their breakdown due to light and air. The method we have discovered to stabilize hydrocracked oils is not believed to be disclosed or suggested by any prior art.

SUMMARY OF THE INVENTION

The invention provides a method of stabilizing a hydrocracked lubricating oil from deterioration caused by light and air which comprises adding thereto a stabilizing amount of a compound of the formula:

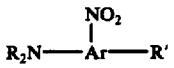

wherein Ar is phenyl or diphenyl, R is the same or different and is phenyl, hydrogen or an alkyl group having from 1 to 18 carbon atoms, preferably 1 to 6 carbon atoms and R′ is hydrogen or an alkyl or alkoxy group wherein the alkyl portion of each also has from 1 to 18 carbon atoms, preferably 1 to 6 carbon atoms, and wherein the $N0_2$ and $R_2N$ groups are ortho or para to each other.

DESCRIPTION OF SPECIFIC EMBODIMENTS

As was stated hereinabove, the compound effective in the practice of this invention has the formula:

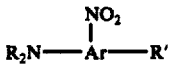

The $R_2N$ portion of the compound can be the phenylamino group, the amino group ($NH_2$) or an alkylamino group containing either one or two alkyl groups. The alkylamino group can be methylamino, dimethylamino, ethylamino, diethylamino and the corresponding groups in the series from propyl to octadecyl. R′ can be a $C_1$–$C_{18}$ alkyl attached directly to the ring carbon or it can be a $C_1$–$C_{18}$ alkyl attached to the ring carbon through oxygen, that is, as an alkoxy group. Illustrative are methoxy, ethoxy, butoxy and hexoxy.

The hydrocracked stock employed in this invention may be obtained by subjecting to known hydrocracking techniques a charge stock boiling above the gasoline range. The stock may include virgin heavy distillate oils or residual fractions boiling at about 650° F or higher. It may also contain cycle stock and the like. These stocks may be asphaltic, or they may be deasphalted prior to hydrocracking.

In connection with this invention, it should be understood that the invention is not to be limited to any particular hydrocracking procedure since any conventional hydrocracked petroleum-derived products can be used.

It has been found that hydrocracked oils can be stabilized with quantities of the amino nitroaromatic compound within the range from 0.05% to about 2.0%, preferably from about 0.1% to about 1.0% by weight. Of course, more may be used if desired, but beyond the 2.0% level of concentration, any small gain in stability is outweighed by the additional cost of the additive.

Having described the invention in its broad, general aspects, the following are offered as examples of its practice.

EXAMPLES

The table below, Table I, summarizes the data obtained with selected stocks and additives. The procedure, simply, involved placing the stock in a convenient size test tube, adding the amino nitroaromatic compound to it and placing it on a windowsill for exposure to light. The temperature was ambient.

The results are expressed in the number of days before the appearance of sediment.

TABLE I

| Example | Stock | Without Additive | 0.1% NDA* | 0.5% NDA* | 0.1% NPT** |
|---|---|---|---|---|---|
| 1 | 100 sec. neutral | 5 | 14 | — | — |
| 2 | 120 sec. neutral | 4 | 8 | — | 6 |
| 3 | 250 sec. neutral | 5 | 12 | >14 | 7 |
| 4 | 500 sec. neutral | 6 | >14 | — | 7 |

*2-nitrodiphenylamine

**3-nitro-4-aminotoluene (2-nitro-p-toluidine)

We claim:

1. A method of stabilizing a hydrocracked lubricating oil from deterioration caused by light and air comprising adding to said oil a stabilizing amount of a compound of the formula:

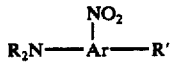

wherein Ar is phenyl or diphenyl, R is the same or different and is selected from the group consisting of phenyl, hydrogen and alkyl containing from 1 to 18 carbon atoms and R′ is hydrogen or an alkyl containing from 1 to 18 carbon atoms, and wherein the $R_2N$ and $N0_2$ groups are ortho or para to each other.

2. The method of claim 1 wherein the $NR_2$ and $N0_2$ groups are ortho to each other.

3. The method of claim 1 wherein the $NR_2$ and $N0_2$ groups are para to each other.

4. The method of claim 1 wherein the compound is 3-nitro-4-aminotoluene.

5. The method of claim 1 wherein the compound is 2-nitrodiphenylamine.

6. The method of claim 1 wherein the compound is present in an amount of from about 0.05% to about 2.0% by weight.

7. The method of claim 6 wherein the compound is present in an amount of from about 0.1% to about 1.0% by weight.

* * * * *